United States Patent [19]

Storry

[11] Patent Number: 4,957,300

[45] Date of Patent: Sep. 18, 1990

[54] RECREATIONAL PROJECTILE

[76] Inventor: Joel C. Storry, 9443 N. 33rd Way, Phoenix, Ariz. 85028

[21] Appl. No.: 286,217

[22] Filed: Dec. 19, 1988

[51] Int. Cl.[5] ..... A63B 65/00

[52] U.S. Cl. ..... 273/428

[58] Field of Search ..... 273/428, 65 R, 65 EE; 267/166, 166.1, 167, 180, 149, 153, 141

[56] References Cited

U.S. PATENT DOCUMENTS

| | | | |
|---|---|---|---|
| 198,843 | 1/1878 | Godley | 267/166 |
| 1,486,807 | 3/1924 | Skala | 273/428 X |
| 1,523,225 | 1/1925 | Lukens | 267/166 |
| 2,441,166 | 5/1948 | Raspet | 267/180 |
| 2,683,603 | 7/1954 | Gackenbach | 273/428 |
| 2,852,424 | 9/1958 | Reinhart et al. | 267/149 X |
| 3,300,042 | 1/1967 | Gordon | 267/166.1 |
| 4,003,574 | 1/1977 | MacDonald et al. | 273/428 X |
| 4,473,217 | 9/1984 | Hashimoto | 267/166 X |
| 4,765,602 | 8/1988 | Roeseler | 267/166 X |

FOREIGN PATENT DOCUMENTS

| | | | |
|---|---|---|---|
| 63140 | 5/1981 | Japan | 267/180 |

*Primary Examiner*—Paul E. Shapiro

*Attorney, Agent, or Firm*—Cahill, Sutton & Thomas

[57] ABSTRACT

A recreational projectile is provided, which in one embodiment displays rotational motion imparted when the projectile is thrown, similar to the motion of a turning screw. The recreational projectile comprises a strip of resilient plastic coiled into a compressible helix at an angle of helical advancement sufficient to prevent adjacent windings of the coiled strip from overlapping each other when in an uncompressed state.

4 Claims, 1 Drawing Sheet

RECREATIONAL PROJECTILE

FIELD OF THE INVENTION

The invention described herein relates generally to the field of recreational objects. More particularly, this invention relates to recreational projectiles. When effectively thrown, one embodiment of the recreational projectile of the present invention simulates the motion of a turning screw.

DESCRIPTION OF THE PRIOR ART

Many games incorporate balls or other projectiles. Some games depend on accuracy in throwing and catching balls. The requirement of accuracy necessarily means that a player must learn how best to grasp and throw the ball, if the player is to master the game. Simply observing the flight path of a properly thrown projectile does not normally provide appropriate feedback information to meaningfully improve a player's technique. Accordingly, to master such games often takes a relatively long period of time, since improvement results only after long hours of trial-and-error, together with empirical observations using various throwing techniques.

In particular, footballs and football-shaped objects are frequently used for recreation in the United States. However, conventional footballs are very difficult to hold or throw properly. The ellipsoidal shape of a football requires that a football be thrown lengtwise rather than crosswise in order to cover the most distance in the least time. To optimize the throwing of a football, the football should be released such that a rotational spin, around the football's longitudinal axis, is imparted to the football. Therefore, an effectively thrown football will spin through the air, without wobbling, in its intended, most direct flight path.

However, conventional footballs have a solid surface and color. Therefore, even the keenest observer of a football in flight will be prevented from determining whether and to what extent rotational spin has been imparted to the thrown football.

U.S. Pat. No. 4,003,574 to MacDonald, et al., discloses a football-shaped projectile. A plurality of weights are symmetrically placed in the outer wall of the projectile. The weights are intended to give the projectile greater rotational stability. The projectile also includes a longitudinal Venturi-like nozzle passage to eliminate drag on the projectile. However, the MacDonald projectile appears to be as difficult to grasp and maneuver as a conventional football. In fact, the added weights no doubt make the projectile heavier and therefore possibly more difficult to grasp and throw. The MacDonald projectile is similar in appearance to conventional footballs. Therefore, an observer will not be able to ascertain whether the MacDonald projectile is rotating most effectively when thrown.

A projectile which includes rounded contours for easy handling and throwing is disclosed in U.S. Pat. No. 2,683,603 to Gackenbach. The projectile is hollow and is deliberately given a warped and eccentric construction so that it will follow an unpredictable flight path when thrown. Although the projectile is easy to handle and thrown, the Gackenbach projectile is not intended to perform like a conventional football. For this reason, a user of the Gackenbach projectile will learn very little about how to improve the throwing of conventional projectiles, such as footballs.

SMMARY OF THE INVENTION

The recreational projectile of the present invention may be summarized in terms of a preferred embodiment wherein the projectile displays rotational motion when thrown. The projectile is produced from a strip of resilient plastic coiled into a compressible helix at an angle of helical advancement sufficient to prevent adjacent windings of the coiled strip from overlapping each other.

It is a first object of the present invention to provide safe and easy-to-handle recreational projectiles for use by any age group.

It is a second object of the present invention to provide recreational projectiles of many different shapes and sizes.

It is a third object of the present invention to provide a rotationally stable recreational projectile.

It is a fourth object of the present invention to provide a recreational projectile which displays rotational motion when thrown so that an observer can more readily determine if the projectile was thrown with the appropriate amount of rotational spin.

It is a fifth object of the present invention to provide a recreational projectile which can be deflected in the hand and can de-accelerate safely upon impact.

Other objects, advantages and features of the present invention will become apparent from the following specification when taken in conjunction with the accompanying drawings.

DESCRIPTION OF TWO PREFERRED EMBODIMENTS

Figure 1A:
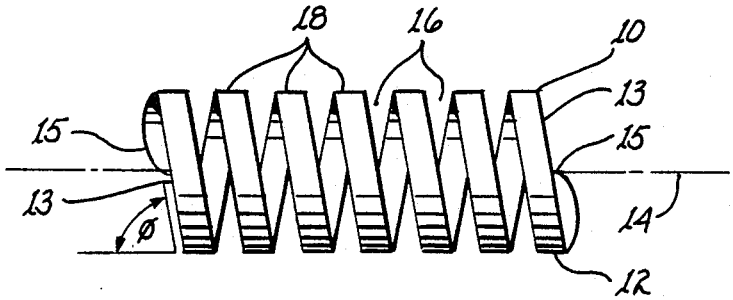
FIG. 1*a* is a cylindrical embodiment of the present invention.
Figure 1B:
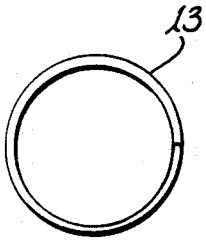
FIG. 1*b* is a cross-sectional view of the cylindrical embodiment shown in FIG. 1*a*.

Referring to FIG. 1*a*, the recreational projectile 10 comprises a strip of resilient plastic 12 which has been coiled into a helix defining a generally cylindrical volume. The recreational projectile 10 is substantially symmetrical about its longitudinal axis 14. Recreational projectile 10 has openings 13 at both ends; preferably, the ends 15 of the coiled strip 12 are tapered, and tucked into the end openings 13 to prevent injury from the ends 15 protruding in such a way as to cause discomfort or injury to a person using the projectile. FIG. 1*b* shows a cross-sectional view of one end of the recreational projectile 10 illustrated in FIG. 1*a*.

Gaps 16 are present between adjacent coils 18 of the projectile 10. Therefore, the projectile 10 can be compressed to a smaller size in the hand by squeezing the coils 18 together, for a better grip and more control. Projectile 10 may also be longitudinally compressed when it strikes something or is caught, thereby de-accelerating the recreational projectile 10. This deacceleration of the projectile 10 upon contact provides a safety feature and makes it easier to catch because kinetic energy is temporarily stored in the helix rather than being transferred to the person who catches it.

When released from a compressed state, cylindrical recreational projectile 10 springs back to its intended, original shape. Therefore, the resilient plastic strip 12 used of form the cylindrical recreational projectile 10 should be made from a material which can retain a "memory" for the coiled helix shape. Such memories can be implanted by heat-treating the plastic, such as when forming the coiled helix around a mandrel having a shape similar to that of the desired game projectile, or, alternatively, by injection molding.

The gaps 16 are created during helxi formation by coiling the plastic strip 12, either by itself or with the use of a mandrel, at a slight angle of helical advancement $\phi$. The angle of helical advancement 100 may advantageously be in the range of about 10°-20°.

Figure 2:
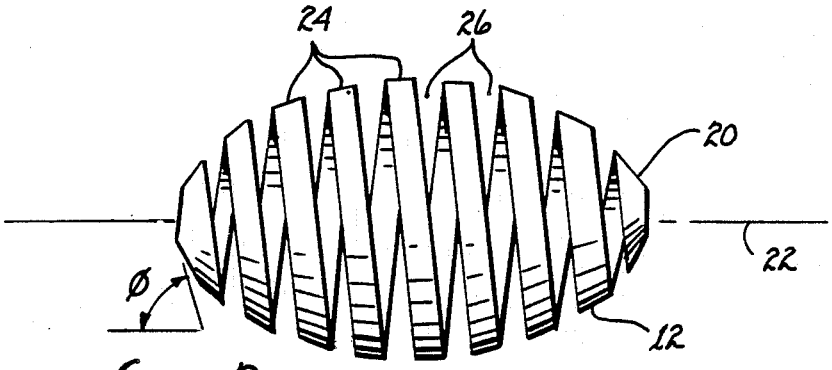
FIG. 2 is an ellipsoidal or football-like embodiment of the present invention.

Referring to the second embodiment of the invention shwon in FIG. 2, the projectile 20 defines a generally ellipsoidal volume similar to an American football. As with the cylindrical projectile 10 illustrated in FIGS. 1*a* and 1*b*, the ellipsoidal projectile 20 is generally symmetrical about its longitudinal axis 22. The ellipsoidal recreational projectile 20 has been formed at a sufficient angle of helical advancement 100 to provide gaps 26 between adjacent coils 24.

Figure 3:
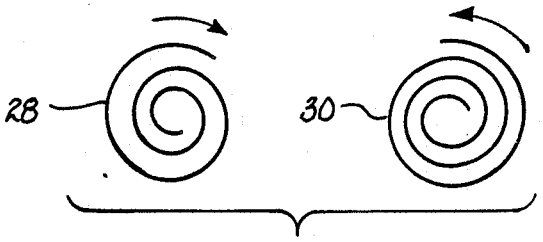
FIG. 3 is a sectional view of two helixes, illustrating right-and left-handed configurations.

FIG. 3 illustrates a cross-sectional view of two helixes. Helix 28 is a right-hand helix because the coils advance away from the observer in a clockwise direction. Both the cylindrical recreational projectile 10 and the ellipsoidal recreational projectile 20, illustrated respectively in FIGS. 1*a* and 2, are right-hand helixes. Helix 30 in FIG. 3 is a left-hand helix because its coils advance away from the observer in a counter-clockwise direction. Right-handed people will impart a spin that will make a right-hand helix appear to thread its way through the air during its flight; left-handed people will impart a spin with similar effect to a left-hand helix.

The recreational projectile of the present invention will preferably be constructed with small gaps and a smaller overall diameter for a child's hand, and larger gaps with a corresponding larger overall diameter for an adult's hand. The gaps between adjacent sections of coil should be in the range of approximately 0.125 to 0.05 inches, preferably approximately 0.25 inches for the average adult.

When thrown, the recreational projectile of the present invention has flight stability arising from at least two physical phenomena, (a) angular momentum and (b) air resistance. Angular momentum is generated when the projectile is thrown. The throwing force that produces spin about the longitudinal axis is a torque that results in angular momentum due to the rotational inertia of the projectile, which is a function of its mass and geometry, and the rate of spin, or angular speed. The angular momentum produces a gyroscopic effect whereby the projectile will tend to maintain the same attitude in space throughout its free flight, subject to changes in attitude and flight path caused by outside forces acting on it, such as air resistance and gravity.

Air resistance also contributes to flight stability. Since the projectile has a much smaller material profile viewed from the end of its longitudinal axis, rather than from an angle to the axis or broadside, the force exerted by the air against the projectile material as the projectile sails through the air will be less where it impinges on less material (axially) than where it impinges no more material. The net effect of this imbalance in forces tends to move the projectile into an attitude of least air resistance, i.e., an axial attitude. This phenomenon is the same one that causes a paper airplane to glide, or a leaf to waft back and forth as it floats to the ground instead of falling flatly against the air pressure beneath its surface.

The alternation of coils and gaps in the turning helix of a recreational projectile of the present invention thrown with the appropriate amount of rotational spin displays rotational motion by giving the appearance of a projectile "threading" through the air as with a turning screw or bolt. Therefore, an observer can more easily determine if the recreational projectile has been thrown most effectively, because improperly thrown recreational projectiles will wobble and fail to give the appearance of a turning screw.

As previously discussed, either embodiment of the present invention can be formed by simply coiling a strip of resilient plastic into the desired shape at an angle of helical advancement which will yield the appropriate size gap between adjacent coils; alternatively, a mandrel having a shape similar to the desired helix can be used to provide support and shape during the coiling. The plastic strips should preferably be between 0.25 inches and 1.25 inches wide.

Figure 4:
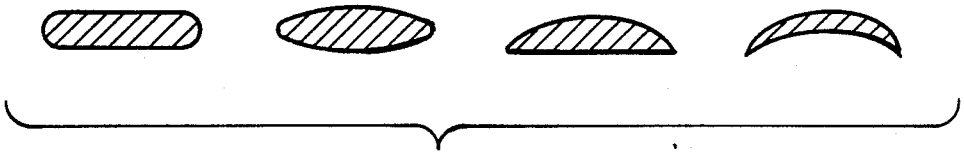
FIG. 4 illustrates cross-sectional views of several different configurations of plastic strips which may be used to form the recreational projectile of the present invention.

FIG. 4 illustrates several configurations of the many cross-sectional shapes which may be used for the strip of resilient plastic. Alternatively, recreational projectiles can also be formed from plastic materials by injection molding.

EXAMPLE

An eight inch long ellipsoidal recreational projectile was formed by coiling a six foot strip of plastic in a righ-hand helix. This plastic strip had a width of 11/16 inches, a thickness of 7/32 inches, and was formed using an angle of helical advancement of approximately 12°. The resultant projectile had nine coils with a 0.25 inch gap between coils. The center of the ellipsoidal helix had a diameter of approximately 4.5 inches. The opening at each end of the helix had a diameter of approximately two inches.

It should be clear that any size or shape recreational projectile can be manufactured to embody the present invention. For example, a spherical recreational projectile can be made, in additional to the cylindrical and ellipsoidal embodiments discussed at length above. The springiness and compressibility of a recreational projectile embodying the present invention can be modified by using plastic strips of varying stiffness, thickness, or shape.

It is to be understood that the present invention is not limited to the particular consturction shown and sescribed in this application, but embraces all equivalent forms.

What is claimed is:

1. A recreational projectile which displays rotational motion imparted when said projectile is thrown, said projectile comprising a lightweight strip of resilient plastic, the strip having a noncircular, elongated cross-sectional area with a width - to - thickness ratio of at least 3, the strip being coiled into a readily comprssible helix which defines a generally cylindrical volume, the helix having substantially uniform gaps in the range of approximately 0.125 to 0.50 inches between adjacent windings of the coiled strip to impart the visual impression of a rotating screw when the projectile is thrown.

2. The recreational helix of claim 1 wherein the strip is gradually tapered at both ends of the helix and the tapered ends are tucked inside the helix.

3. A recreational projectile which displays rotational motion imparted when said projectile is thrown, said projectile comprising a lightweight strip of resilient plastic, the strip having a noncircular, elongated cross-sectional area with a width - to - thickness ratio of at least 3, the strip being coiled into a readily compressible helix defining a generally ellipsoidal volume, said strip coiled at an angle of helical advancement sufficient to create between adjacent windings of the coiled strip substantially uniform gaps of between approximately 0.125 and 0.50 inches to impart the visual impression of a rotating screw when the projectile is thrown.

4. The recreational projectional of claim 3 wherein the strip is gradually tapered at both ends of the helix and the tapered ends are tucked inside the helix.

* * * * *